US011432666B1

(12) United States Patent
Kessler

(10) Patent No.: US 11,432,666 B1
(45) Date of Patent: Sep. 6, 2022

(54) CUP LID

(71) Applicant: Aaron Christopher Kessler, Hoboken, NJ (US)

(72) Inventor: Aaron Christopher Kessler, Hoboken, NJ (US)

( * ) Notice: Subject to any disclaimer, the term of this patent is extended or adjusted under 35 U.S.C. 154(b) by 297 days.

(21) Appl. No.: 16/010,401

(22) Filed: Jun. 15, 2018

Related U.S. Application Data

(60) Provisional application No. 62/520,465, filed on Jun. 15, 2017.

(51) Int. Cl.
*A47G 19/22* (2006.01)
*F04D 25/12* (2006.01)

(52) U.S. Cl.
CPC ..... *A47G 19/2205* (2013.01); *A47G 19/2288* (2013.01); *F04D 25/12* (2013.01)

(58) Field of Classification Search
CPC ..... A47G 19/2205; A47G 19/2288; A47J 31/005; A47J 31/0636; A47J 31/02; A47J 31/18; A47J 41/0011; F25D 3/08; F04D 25/12
See application file for complete search history.

(56) References Cited

U.S. PATENT DOCUMENTS 5,062,281 A * 11/1991 Oliphant ..... F24F 5/0017 62/457.1
6,227,004 B1 * 5/2001 Gerstein
7,178,357 B2 * 2/2007 Link ..... B60H 1/00264 62/440
2004/0056040 A1 * 3/2004 Ziegler ..... A47G 19/2272 220/847
2008/0112459 A1 * 5/2008 Salkeld ..... A47G 19/2272 374/141
2009/0107997 A1 * 4/2009 Cornelius ..... B65D 43/0231 220/212
2009/0223969 A1 * 9/2009 Bouie ..... B65D 43/169 220/375
2010/0187247 A1 * 7/2010 Ziegler ..... B65D 25/2817 220/783
2010/0208549 A1 * 8/2010 Kitson ..... A47J 36/165 366/247
2012/0293332 A1 * 11/2012 Rosenfeld ..... A47J 41/0094 340/584
2013/0341443 A1 * 12/2013 Stephenson ..... A47J 43/27 241/38
2016/0199261 A1 * 7/2016 Morgan ..... A61J 7/0481 368/10
2016/0364814 A1 * 12/2016 Yekutiely ..... F25D 3/08
2017/0340147 A1 * 11/2017 Hambrock ..... G01F 23/0076

* cited by examiner

*Primary Examiner* — Moshe Wilensky
*Assistant Examiner* — Kyle A Cook
(74) *Attorney, Agent, or Firm* — Nick A Nichols, Jr.

(57) ABSTRACT

A reusable cup lid may be configured for attachment to a beverage container. The cup lid may define a body housing a battery, motor and fan operably connected. A removable cover may include a control circuit with an LED display operably connected to settings and programming buttons. The cup lid may include a drinking port and a venting channel. A charging/external power port may provide for connection directly to an external power source for charging or powering the cup lid. An attachment member may be mounted on the rim of a cup providing a watertight seal. The cup lid may be removably connected to the attachment member.

10 Claims, 6 Drawing Sheets

CUP LID

CROSS-REFERENCE TO RELATED APPLICATION

This application claims priority to and the benefit of the filing date of U.S. Provisional Application Ser. No. 62/520,465, filed Jun. 15, 2017, which application is herein incorporated by reference in its entirety.

BACKGROUND

The present invention relates to cup lids and, more particularly, to a cup lid for cooling and drinking hot liquids.

Hot liquids sold to consumers are regularly served at scalding hot temperatures and a consumer must often wait a significant amount of time for the liquid to naturally cool before it is safe to consume. Because these liquids are served in various disposable cups and in many cases the consumer is outside of the home and in motion, there are very few options to safely and quickly cool a hot liquid without either pouring it into a different cup or by putting something directly into it, both of which may lead to spilling or overflow and cause severe burns. Many known devices or systems have shown limited efficacy, lack of portability, and are impractical for use outside of the home and while the user is in motion.

SUMMARY

A reusable cup lid may be configured for attachment to a beverage container. The cup lid may define a body housing a battery, motor and fan operably connected. A removable cover may include a control circuit with an LED display operably connected to settings and programming buttons. The cup lid may include a drinking port and a venting channel. A charging/external power port may provide for connection directly to an external power source for charging or powering the cup lid. An attachment member may be mounted on the rim of a cup providing a watertight seal. The cup lid may be removably connected to the attachment member.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 2:
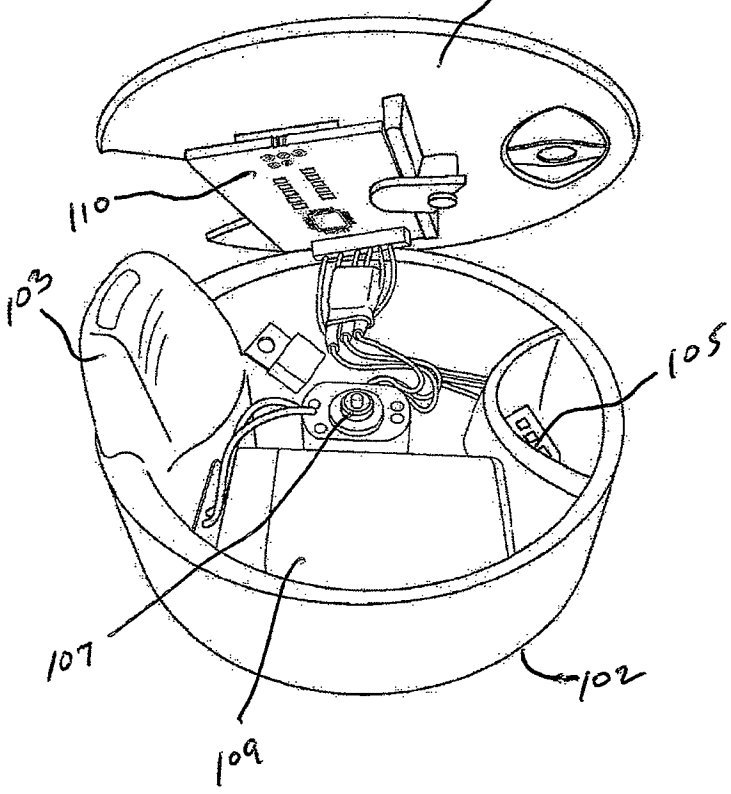
FIG. 2 is a perspective view depicting the interior components of the cup lid shown in FIG. 1.
Figure 1:
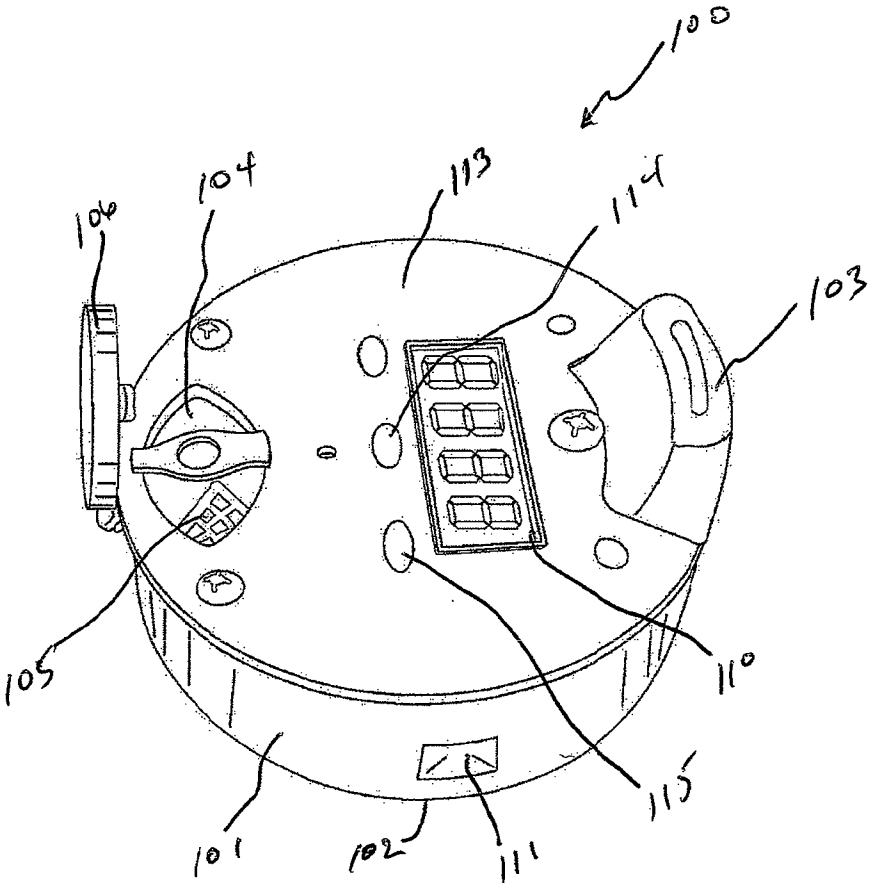
FIG. 1 is perspective view of a cup lid.

Referring first to FIG. 1, a cup lid is generally identified by the reference numeral (100). The cup lid (100) may include a housing for the components of the cup lid (100) defining a lid body (101) that may, for example but without limitation, have a generally circular periphery. The lid body (101) may include a base (102) and a cover (113) in spaced relationship to one another defining a cavity or enclosure therebetween, more clearly shown in FIGS. 2 and 3. The lid body (101) may include an opening for a drinking channel (103) and at least one venting channel (104). The at least one venting channel (104) may have a splash guard (105) to prevent liquid from splashing upward through the venting channel (104). A motor (107) may be attached to the base (102) and positioned so a motor shaft protrudes downward through the base (102). A fan having fan blades (108) extending radially outward from a hub may be attached to the shaft of the motor (107) so that the fan is positioned flush with the bottom side of the base (102). In certain embodiments, a brushless fan or bladeless fan configuration may be used eliminating the need for a separate motor (107) and fan blades (108).

An internal power source (109) may be operably wired to the motor (107) and a circuit board with LED display (110). The internal power source (109) may be a battery and the like. In its current embodiment, the device may be powered either by an internal power source (109) or may include a charging/external power port (111) for connection directly to an external power source, such as but without limitation, a car connection, home outlet, USB port and the like. In certain embodiments, the internal power source (109) may be eliminated and the cup lid (100) may be powered solely by connecting the charging/external power port (111) to an external power source. Elimination of the internal power source (109) may allow for a thinner design of the lid body (101) resulting in a more compact and portable cup lid (100).

An internal power source (109) may be operably wired to the motor (107) and a circuit board with LED display (110). The internal power source (109) may be a battery and the like. In its current embodiment, the device may be powered either by an internal power source (109) or may include a charging/external power port (111) for connection directly to an external power source, such as but without limitation, a car connection, home outlet, USB port and the like. In certain embodiments, the internal power source (109) may be eliminated and the cup lid (100) may be powered solely by connecting the charging/external power port (111) to an external power source. Elimination of the internal power source (109) may allow for a thinner design of the components housing (101) resulting in a more compact and portable cup lid (100).

Figure 3:
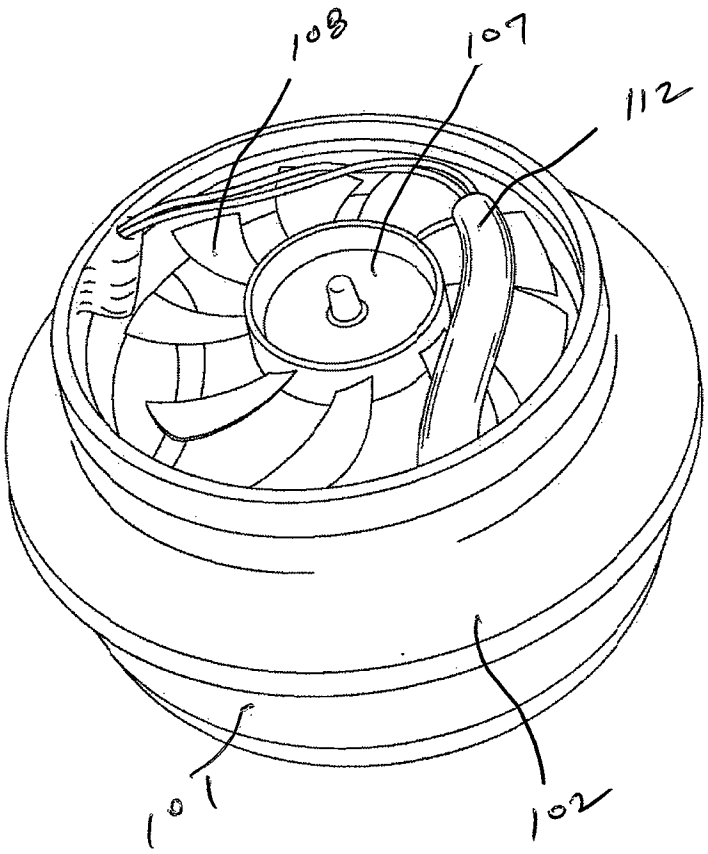
FIG. 3 is a bottom perspective view of the cup lid shown in FIG. 1.
Figure 6:
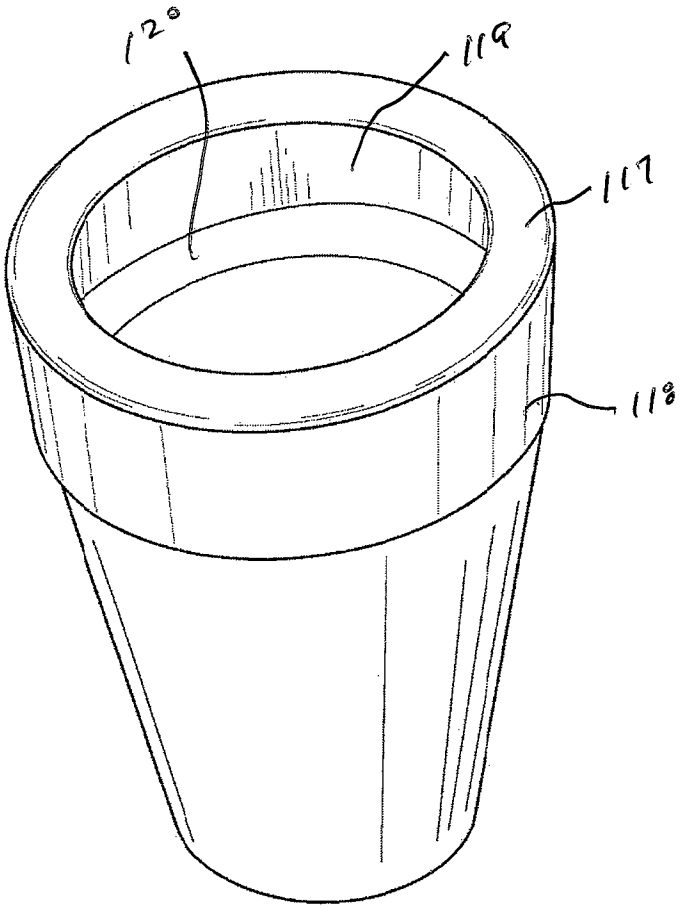
FIG. 6 is a perspective view depicting the attachment member mounted on the rim of a cup.
Figure 5:
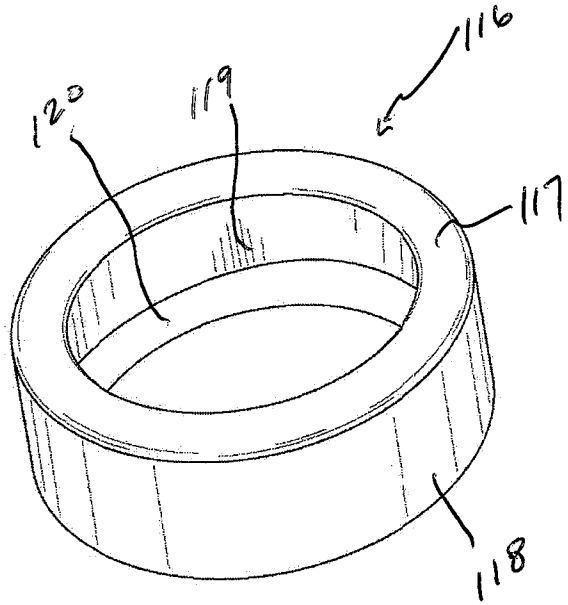
FIG. 5 is bottom perspective view of the attachment member for securing the cup lid shown in FIG. 1 to a rim of a cup.
Figure 8:
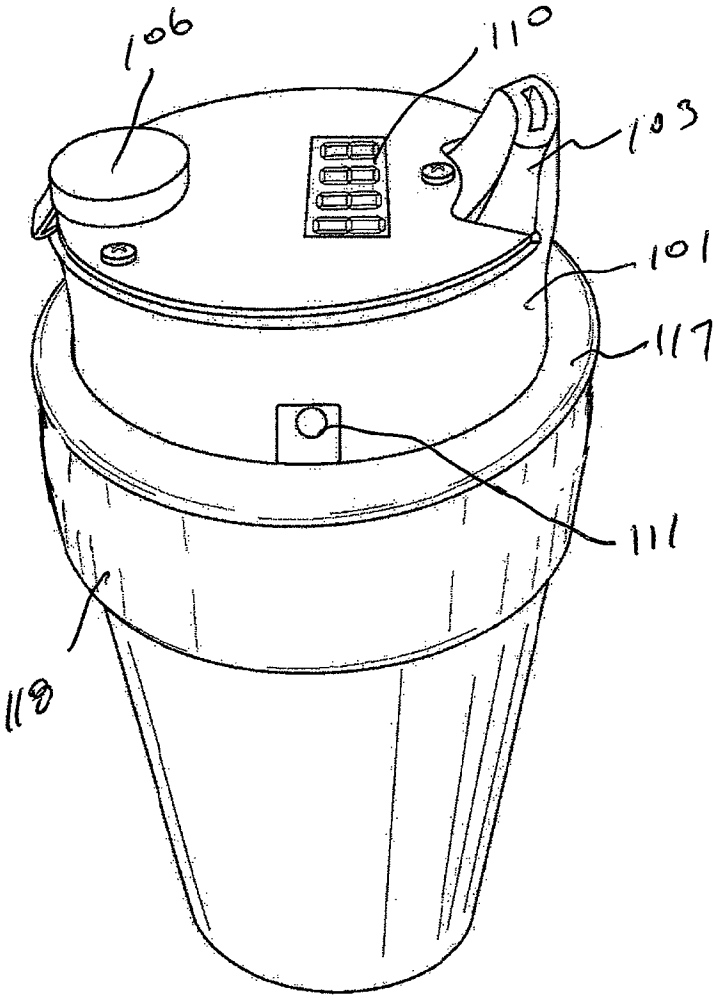
FIG. 8 is a perspective view of the cup lid shown in FIG. 1 attached to the attachment member mounted on a cup.
Figure 7:
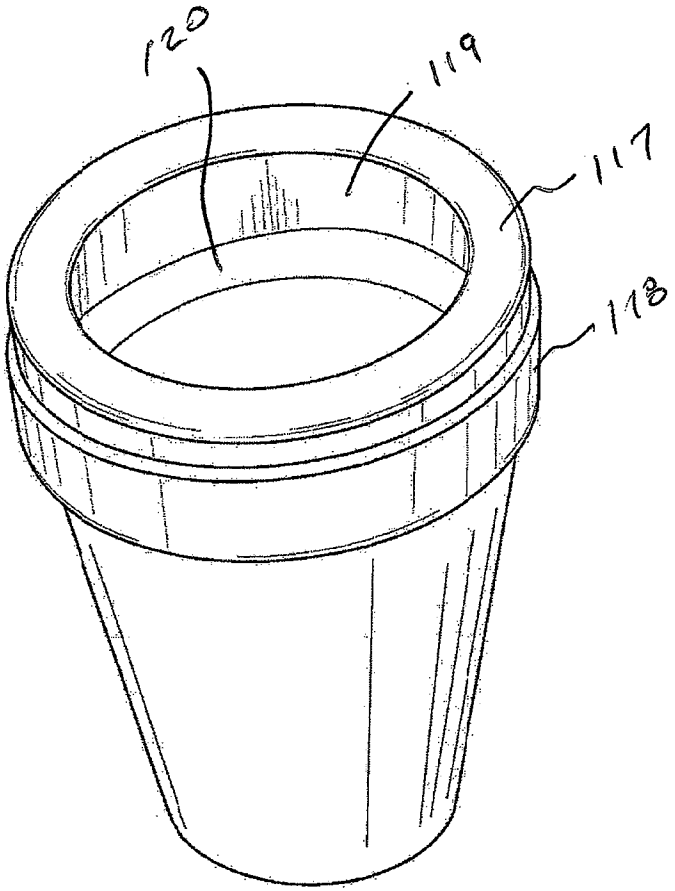
FIG. 7 is a perspective view depicting the attachment member mounted on the rim of a cup.

Referring now to FIG. 3, a thermometer probe (112) may be operably wired to the circuit board with LED display (110) and positioned on the bottom side of the base (102). When the cup lid (100) is in use, the thermometer probe (112) may extend into a hot liquid contained in a cup and measure the temperature of the liquid which may then be displayed on the circuit board with LED display (110) for the user to see.

A top cover (113) may be removably attached to the lid body (101) and include openings for a power/programming button (114), settings button (115), circuit board with LED display (110), and at least one venting channel (104). The power/programming button (114) and settings buttons (115) may be operably wired to the circuit board with LED display (110) in order to control the settings of the cup lid (100). The power/programming button (114) may be actuated to enter different programming modes and to start/stop the motor (107) thereby controlling the motion of the fan blades (108). The components of the cup lid (100) may be sealed within the lid body (101) so that the cup lid (100) is waterproof.

When the top cover (113) is in place, the at least one venting channel (104) may be covered by a venting channel flap (106) which may be operable to move from a substantially opened position to a substantially closed position and back via hinges, a swivel motion, slide motion, push motion and the like. When the cup lid (100) is active in a cooling process and the venting channel flap (106) is in a substantially open position, heat in the form of steam may be allowed to escape out of the cup and into the air through the at least one venting channel (104) to accelerate a cooling process for a hot liquid that may be within the cup.

Figure 4:
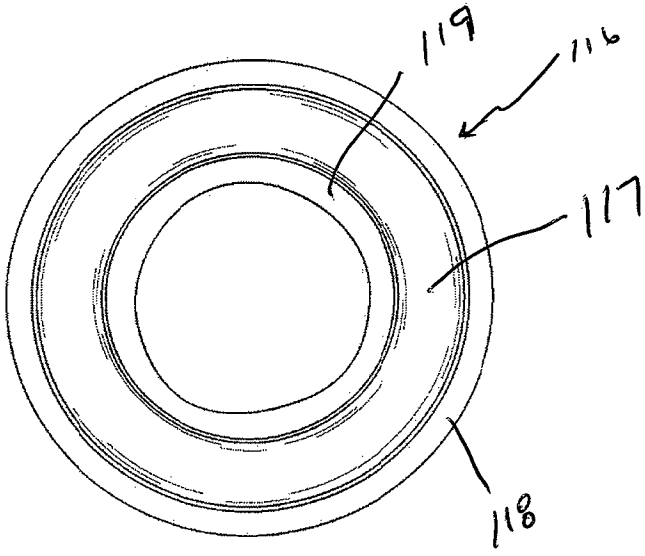
FIG. 4 is top perspective view of an attachment member for securing the cup lid shown in FIG. 1 to a rim of a cup.

Referring now to FIGS. 4-8, a cup lid attachment member (116) which is separable from the housing body (101) may secure the cup lid (100) to the rim of different sized cups. It is understood however that the attachment member (116) may also be specially designed for use with cups from specific manufacturers or retailers and may not fit different sized cups. The attachment member (116) may be open at both ends having an open ended upper rim (117), a heat sleeve (118) and a lower rim (119). When in use, the attachment (116) may be seated on the rim of a cup with the lower rim (119) extending into the cup. A seal, such as but without limitation, a seal ring (120) may be positioned about the lower rim (119) of the attachment (116), shown in FIG. 5, to create a watertight seal with the inside wall of a cup. The attachment heat sleeve (118) may be fabricated of a malleable material. To secure the attachment (116) to a cup, the heat sleeve (118) may be unfolded by pulling downwardly until it engages the outside wall of a cup. When the attachment (116) is not in use, the heat sleeve (118) may be folded upwardly allowing the lower rim (119) to collapse into the upper rim (117), as shown in FIG. 4. The heat sleeve (118) may also protect a user's hands from a hot liquid contained in the cup eliminating the need for a separate cardboard heat sleeve.

The attachment member (116) may be secured to the top of a cup by extending the lower (119) to its full length and seating the attachment member (116) over the rim of the cup. An upper region of the cup may thereby be captured between the heat sleeve (118) and the lower rim (119). Upon assembly, the heat sleeve (118) and the lower rim (119) are in sealing contact with an upper portion of the outer and inner surface of the wall of the cup, respectively, forming a watertight seal with the upper portion of the cup.

The attachment member (116) may include an internally threaded portion proximate the upper rim (117) for mating engagement with an externally threaded portion proximate the base (102) of the cup lid (100). The cup lid (100) may be secured to the attachment member (116) by using a pushing or screwing motion and the like to engage the threaded portions of the attachment member (116) and the cup lid (100). A seal ring (120) may be positioned about the outside of the cup lid (100) proximate the base (102) which may engage an inner portion of the attachment member (116) forming a watertight seal.

Figure 10:
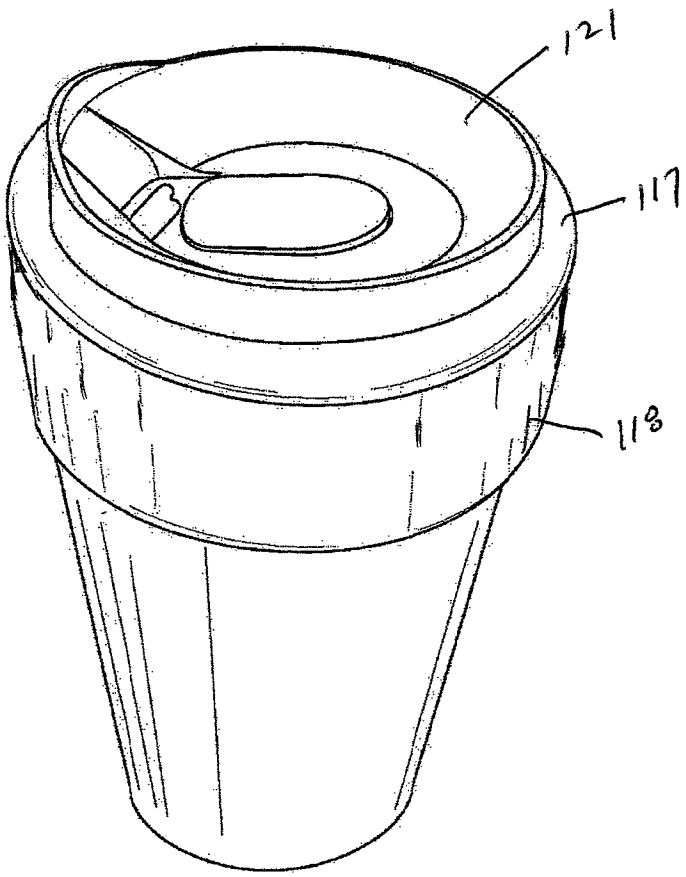
FIG. 10 is a perspective of the cup lid shown in FIG. 9 attached to cup.
Figure 9:
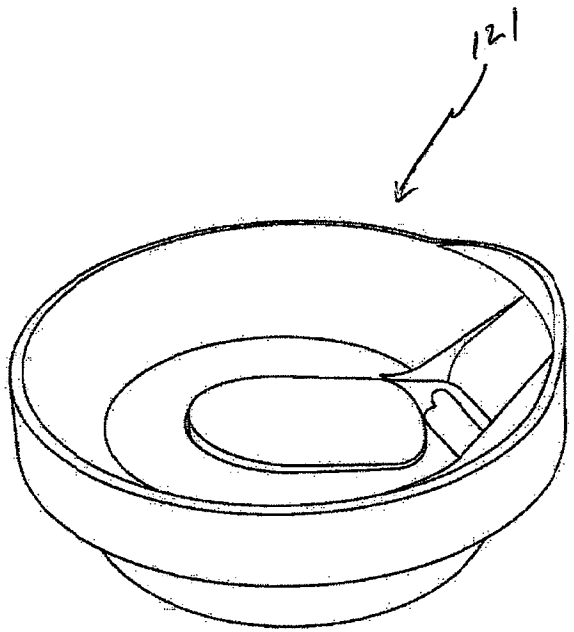
FIG. 9 is a perspective view of an alternate embodiment of a cup lid.
Figure 12:
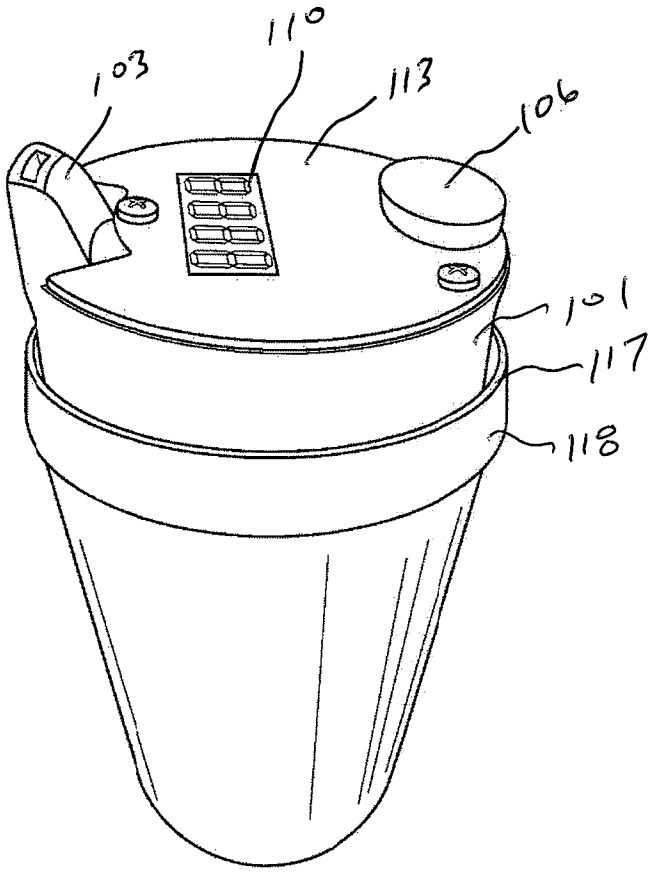
FIG. 12 is a perspective view of the cup lid attached to a cup.

After a cooling process has ended, if a user desires a more compact configuration the cup lid (100) may be removed from the attachment (116) and an optional replacement lid (121) may be secured to the attachment and used in its place. The optional replacement lid (121) shown in FIGS. 9 and 10, may provide an externally threaded ring for mating engagement with the internally threaded ring of the attachment upper rim (117) and may be secured to the attachment (116) by a using a pushing or screwing motion and the like.

A user may substitute the replacement lid (121) for the cup lid (100) as desired. For example, but without limitation, after the liquid in the cup has sufficiently cooled, a user may prefer the compact profile of the replacement lid (121) and remove the cup lid (100) and attach the replacement lid (121).

A carrying case (not shown in the drawings) may be provided for the cup lids (100, 200). The carrying case may be used to store the cup lids (100, 200) and attachment member (116), when not in use.

Figure 11:
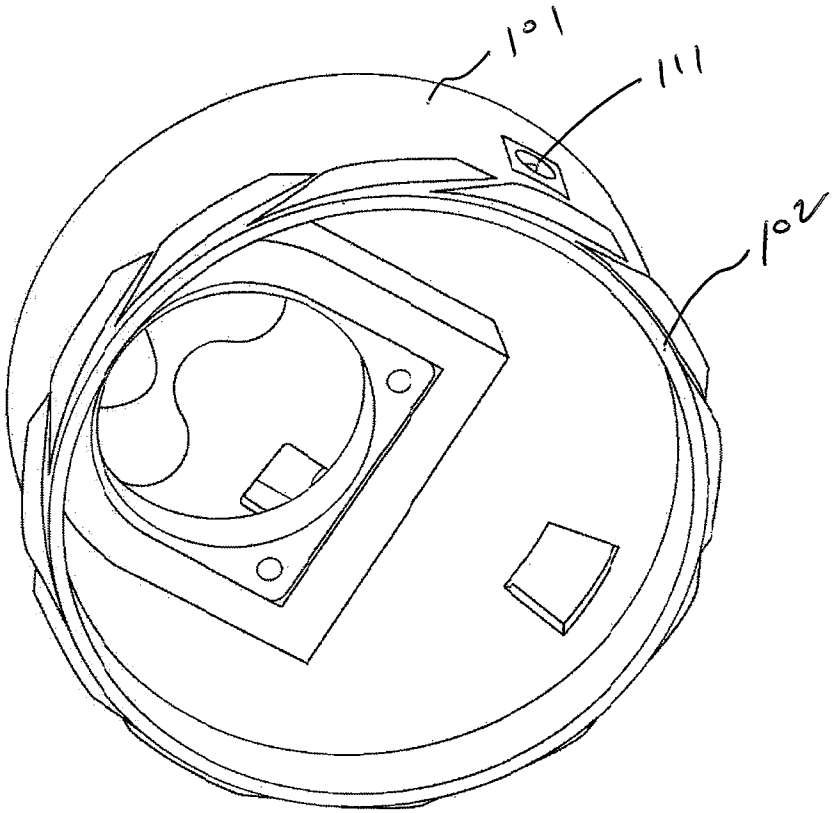
FIG. 11 is a bottom perspective view of the cup lid shown in FIG. 1 with a brushless fan.

In an alternative embodiment of the cup lid shown in FIG. 11, the base (102) may be designed to fit different size cups or to only fit a certain size cup from a specific manufacturer or retailer so that the cup lid may be attached directly to the cup rim.

Those skilled in the art will recognize that the shape and size of components of the cup lid described herein, such as the motor (107), internal power source (109), brushless/bladeless and/or fan blade configurations, may result in varying power and speed configurations. Different configurations may increase or decrease the rate of cooling of a hot liquid contained in a cup and therefore increase or decrease the amount of time a user may have to wait before the hot liquid is safe to consume.

To use the cup lid (100) to cool a hot liquid in a cup a user may first secure the cup lid (100) to the attachment member (116) using a clockwise screwing motion and then remove any existing lid on the cup. Next the user may pull downwardly on the lower rim (119) of attachment member (116) and the thermometer probe (112) so both are in a downward and extended position. The user would then place the attachment (116) onto the rim of the cup seating it into position and then pull downwardly on the heat sleeve (118) to unfold it from its upwardly folded position so that it engages the outside wall of the cup and secures the attachment (116) in place The cup lid (100) may be turned on by pressing the power/programming button (114) which allows the thermometer probe (112) to immediately register a temperature of the liquid contained in the cup which is then displayed on the circuit board with LED display (110) for the user to see. If the liquid is already at the desired temperature the user may immediately drink the liquid with the cup lid (100) in place. If the user wants to cool the liquid, a second press of the power/programming button (114) puts the cup lid (100) into a temperature programming mode. Using the settings buttons (115) with one button used to increase the temperature value and the other button used to decrease the temperature value the user can program a specific temperature which when achieved will cause the cup lid (100) to automatically cut power to the fan blades (108) causing them to stop spinning thereby ceasing the cooling process. By again pressing the power/programming button (114), the cup lid (100) will enter a power programming mode whereby the user can select a desired power value to use thereby controlling the speed of the fan blades (108) and thus control the rate of cooling. By pressing the settings buttons (115), the user can use one button to increase the percentage of power and one button to decrease the percentage of power with 100 being max power and 50 being half power. The user may then open the venting channel flap (106) and again press the power/programming button (114) which will activate the cup lid (100) causing the fan blades (108) to spin thereby actuating a cooling process. Depending on the polarity configuration to the motor (107), the fan blades (108) may spin in either a clockwise or counter clockwise direction. In its present embodiment, the current polarity configuration causes the fan blades (108) to spin in a counter clockwise direction which will force air downward towards the liquid creating an upward pressure that forces heat in the form of steam to travel upward through the venting channel (104) and escape out of the cup and into the air thereby causing the liquid to rapidly cool. Once the liquid reaches the user's programmed temperature the cup lid (100) automatically cuts power to the fan blades (108) causing them to stop spinning thereby ceasing the cooling process. The user may then close the venting channel flap (106) and drink the liquid with the cup lid (100) in place and without taking any additional steps. To power off the cup lid (100) the user may press and the hold the power/programming button (114) or do nothing and the cup lid (100) will eventually power off on its own. Since the cup lid (100) will be used in place of the cup's original lid, if the user desires a more compact configuration they may remove the cup lid (100) from the attachment (116) and use cup lid (200) in its place.

While preferred embodiments of the invention have been shown and described, other and further embodiments of the invention may be devised without departing from the basic scope thereof, and the scope thereof is determined by the claims which follow.

The invention claimed is:

1. A cup lid comprising:

a) a lid body having a generally circular periphery, a base and a cover collectively configured to define a waterproof enclosure;

b) said lid body including a drink port and a vent channel, said drink port and said vent channel extending upwardly from said base;

c) a control circuit operably connecting a power source to a fan, said fan positioned below said waterproof enclosure;

d) an attachment member separable from said lid body, said attachment member removably attaching said lid body to an open end of a cup; and e) a motor housed in said waterproof enclosure, said motor operably connected to said fan and said control circuit.

2. The cup lid of claim 1 including a power port for connecting to an external power source.

3. The cup lid of claim 1 including a temperature probe operatively connected to said control circuit.

4. The cup lid of claim 1 wherein said attachment member includes a foldable portion defining a heat sleeve extendable along an outside wall of the cup.

5. The cup lid of claim 4 wherein said attachment member includes an inner lower rim creating a watertight seal with an inside wall of the cup.

6. A beverage container lid, comprising: a) a lid body including a generally peripheral wall, a base and a top cover collectively defining a waterproof enclosure, said lid body further including a drink port and a vent channel extending upwardly from said base;

b) a power source housed within said waterproof enclosure;

c) a fan suspended below said waterproof enclosure;

d) a control circuit operably connecting said fan to said power source; and e) a lid attachment member configured to removably secure said lid body to an open end of a beverage container.

7. The container lid of claim 6 including a visual display operatively connected to said control circuit.

8. The container lid of claim 6 wherein said lid attachment member includes a foldable portion defining a heat sleeve extendable along an outside wall of the beverage container.

9. The container lid of claim 6 including a temperature probe operatively connected to said control circuit.

10. The container lid of claim 6 wherein said lid attachment member includes an inner lower rim creating a watertight seal with an inside wall of the beverage container.

* * * * *